US005348206A

United States Patent [19]

Scherer

[11] Patent Number: 5,348,206

[45] Date of Patent: Sep. 20, 1994

[54] CARRYING SLEEVE FOR CAMERA

[76] Inventor: Stephen J. Scherer, 39 Warder Dr., Pittsford, N.Y. 14534

[21] Appl. No.: 81,808

[22] Filed: Jun. 23, 1993

[51] Int. Cl.[5] ..... A45C 11/38; B65D 85/30

[52] U.S. Cl. ..... 224/220; 224/257; 224/908; 206/316.2

[58] Field of Search ..... 224/908, 909, 219, 220, 224/202, 257; 206/316.2

[56] References Cited

U.S. PATENT DOCUMENTS

| | | | |
|---|---|---|---|
| Re.33,440 | 11/1990 | Hougen . | |
| Re.33,449 | 11/1990 | Martin . | |
| 2,565,006 | 8/1951 | Trickey | 224/908 |
| 4,601,318 | 7/1986 | Diegelman | 206/316.2 |
| 4,928,819 | 5/1990 | Jakobsen | 224/908 |
| 5,199,563 | 4/1993 | Goodman | 206/316.2 |

FOREIGN PATENT DOCUMENTS

| | | | |
|---|---|---|---|
| 2338945 | 2/1975 | Fed. Rep. of Germany | 206/316.2 |

*Primary Examiner*—Renee S. Luebke
*Attorney, Agent, or Firm*—Cumpston & Shaw

[57] ABSTRACT

A reusable carrying sleeve for a recyclable, single use camera is constructed of resilient foam and includes a peripheral wall section for surrounding a camera housing and a front panel joined to a forward part of the peripheral wall for forming a semi-enclosure around a camera inserted into the sleeve. The front panel has apertures and cut-outs sized and aligned to permit normal functioning of the camera lens, viewfinder, flash, and film winder. A carrying strap is affixed to the peripheral wall for toting around the sleeve and the retained camera. The peripheral wall includes an interior perimetal surface designed with a size and shape to frictionally grip the camera, while the exterior surface of the sleeve can appear plain or have virtually any decorative indicia, making the sleeve particularly attractive to variously aged photographers.

15 Claims, 4 Drawing Sheets

CARRYING SLEEVE FOR CAMERA

FIELD OF THE INVENTION

This invention relates generally to carrying structures for cameras, and more particularly to a reusable, resilient foam sleeve for operatively housing a single use, still-photo camera.

BACKGROUND OF THE INVENTION

A number of innovative marketing strategies confront the consumer of amateur photography equipment. At least several film and camera manufacturers are marketing very inexpensive single use cameras. This type of camera generally employs plastic optical components mounted in a cardboard camera housing, which also contains a ready-to-shoot roll of film. Once the roll of film is exposed, the photographer takes the entire camera to any of a number of conveniently located processing facilities for film development. The camera itself is then either disposed of or recycled and sold anew as a disposable, single use camera.

The advent of recyclable, single use cameras has expanded the population of amateur photographers to include children and, also, casual photographers who no longer hesitate to use their camera in a hostile environment, such as underwater, for example, due to their inexpense. Single use cameras, however, typically lack carrying straps or other fixtures to aid in toting the camera around, and are quite unpretentious in appearance. While the lack of such features adds to the economy of production, their absence may impact the use of such cameras by amateur photographers of various age groups, particularly young children who do not like, or are unable, to hold onto objects for long periods and who are greatly influenced by the appearance of a thing regardless of its function.

Accordingly, it is an object of this invention to provide a carrying sleeve for a single use camera into which the camera can easily be inserted and removed, which is light, easy to carry, reusable, does not interfere with the practical use of the camera, and which helps to protect the camera if it is dropped or banged against another object.

It is another object of the invention to provide a reusable carrying sleeve for a single use camera that is decorative as well functional thus making it especially fun to use by photographers of various ages depending on the decorative appearance of the sleeve.

These and other objects, features, and advantages of the present invention will become apparent from the descriptions and illustrations which follow.

SUMMARY OF THE INVENTION

The present invention describes a reusable carrying sleeve for operatively receiving a camera and includes a peripheral wall for surrounding a camera housing perimeter and a front panel joined along a forward edge of the peripheral wall which forms a semi-enclosure for the camera upon insertion into the sleeve. There is no rear panel. The front panel of the sleeve includes one or more unobstructive apertures for the camera lens, the camera view finder, and the camera flash if so equipped. The peripheral wall may include a cut-away portion for the camera film winding mechanism. The sleeve is composed of resilient foam material and has a general interior size and shape such that a single use camera is held, or actually gripped, in the sleeve by the friction between the deformable, compressible interior foam surface of the sleeve and the camera housing. An inwardly facing extension, or lip, of the wall attached along a rear edge of the sleeve body will further secure the camera in the sleeve. A carrying strap is attached to the sleeve exterior.

In one embodiment of the invention, the sleeve exterior contains decorative three dimensional, indicia. In another aspect of this embodiment, the three dimensional indicia is anthropomorphic. The form taken by such indicia is limitless; however, likenesses of popular cartoon characters, sports figures, and other recognizable personalities, for example, will add to the enjoyment of variously aged users of the invention.

In another embodiment, the invention comprises a molded one-piece foam sleeve having a contoured exterior surface and a differently contoured interior surface. The sleeve contains one or more apertures which are shaped and located so as to permit the unobstructed passage of light to and from the camera lens, the viewfinder, and the flash, when the camera is operatively secured in the sleeve. The interior of the sleeve has a contour of a size and shape which semi-encloses the camera and frictionally secures it in the sleeve due to the deformable and compressible characteristics of the sleeve material.

The preferable use of resilient foam, or foam rubber, for the sleeve material permits the sleeve to be inexpensively manufactured in a variety of shapes by injection molding; makes for a light protective sleeve having a good feel; and, allows the exterior appearance of the sleeve to be independent from the functionally sized and shaped interior.

DETAILED DESCRIPTION OF THE INVENTION

Figure 1:
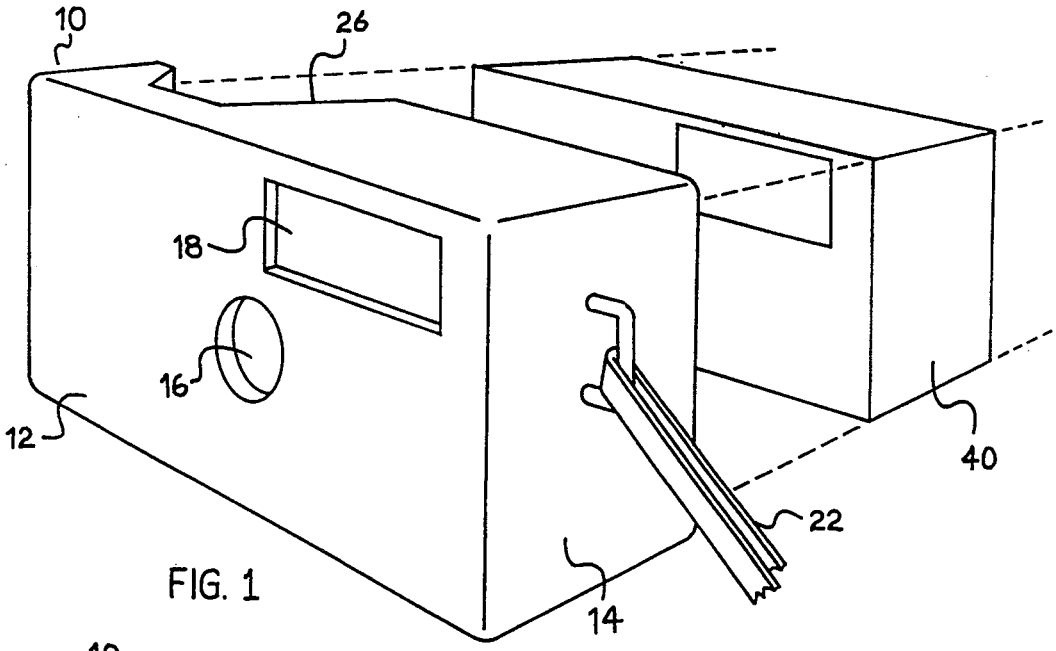
FIG. 1 is a front perspective view of an embodiment of the invention also showing the operative alignment of a single use camera.

Referring to the drawings in which like reference numerals represent like parts throughout the several views, FIGS. 1–7 show different views of the preferred embodiment of the invention.

A resilient foam removable sleeve 10 for receiving and carrying a single use camera 40 (not shown) comprises an object panel 12 against which the camera face rests, unitarily connected to a peripheral wall section 14, which semi-encloses the camera body when the camera is operatively inserted into the sleeve 10. The object panel 12 has a lens aperture 16 appropriately sized and aligned with the lens of the engaged camera to permit light to pass unvignetted to the camera lens, and a viewfinder aperture 18 similarly aligned and positioned with respect to the camera viewfinder to permit normal picture talking with the camera when the camera is retained in the carrying sleeve. The peripheral wall section of the sleeve 10 has an inner perimetal surface 20 which is preferably sized and shaped to generally receive the face and body of a single use camera as described herein above, such as the Funsaver TM camera manufactured by Eastman Kodak Co., and retain the camera therein by frictional force. The use of resilient foam as the preferable material for the camera sleeve 10 allows the sleeve to frictionally grip the camera due to the compressibility and conformability of the foam, and further cushions the camera against blows caused by dropping or hitting the camera against another object.

Figure 2:
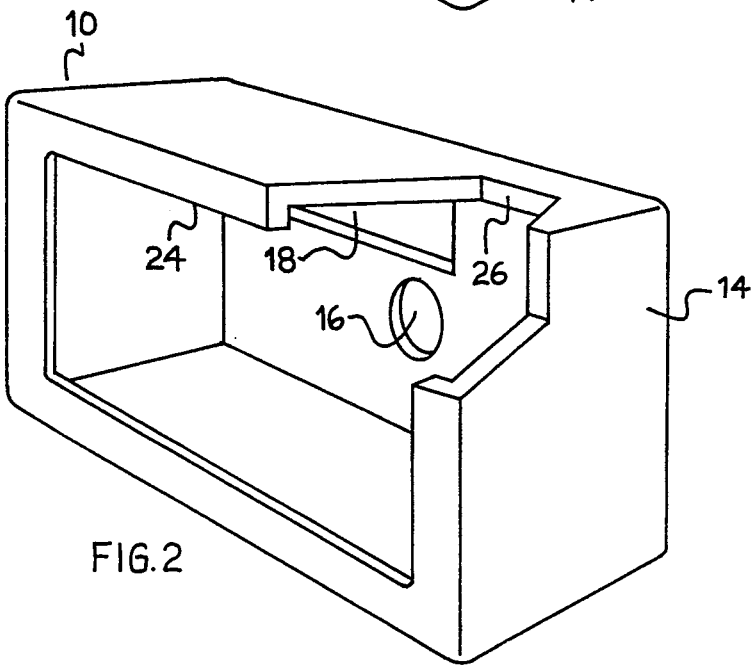
FIG. 2 is a rear perspective view of the invention.
Figure 5:
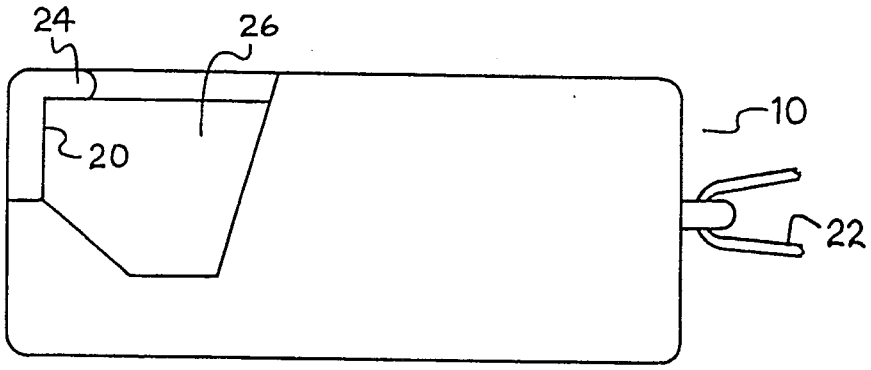
FIG. 5 is a top plan view of FIG. 3 showing a cut-away portion of the sleeve for a film winder mechanism.
Figure 3:
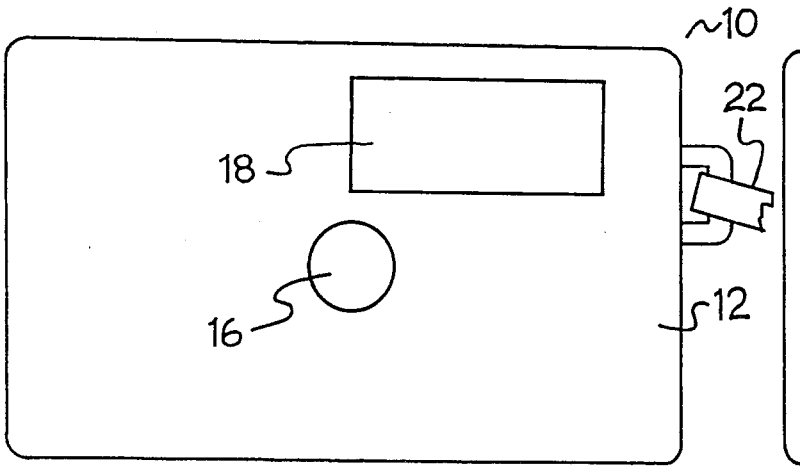
FIG. 3 is a front elevational view of the invention showing a lens aperture and viewfinder aperture.
Figure 6:
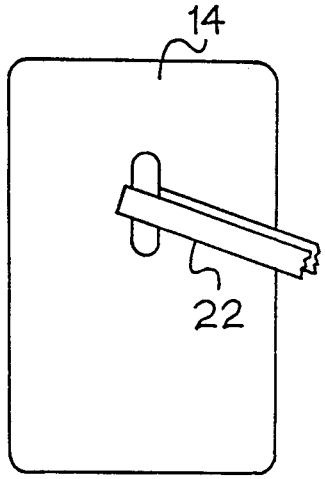
FIG. 6 is a right side view of FIG. 3.
Figure 4:
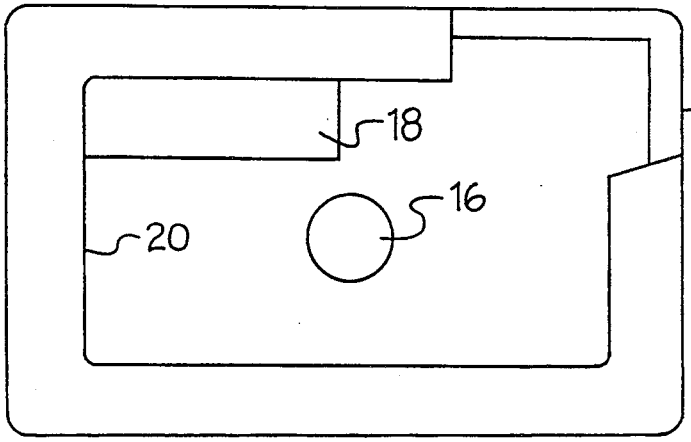
FIG. 4 is a rear elevational view of the invention.
Figure 7:
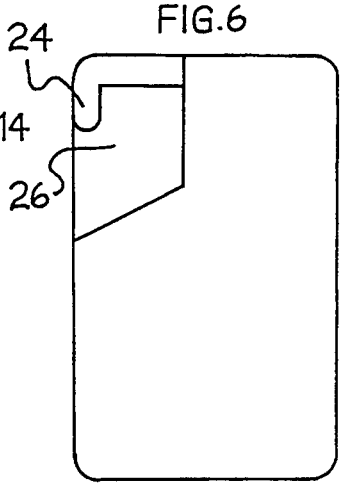
FIG. 7 is a left side view of FIG. 3.

As seen in FIGS. 2, 5, and 7, the rear facing peripheral edge of the peripheral wall 14 of the sleeve may include an extension 24 which provides a lipped surface to further secure the camera in the sleeve once it is fully inserted. The peripheral wall section 14 of the sleeve 10 is also cut away as depicted by numeral 26 to provide an unobstructed portion of the sleeve for the film winder mechanism on the camera body. The sleeve 10 also includes a carrying strap 22 affixed to the wall 14 of the sleeve for conveniently toting the camera around.

Figure 8:
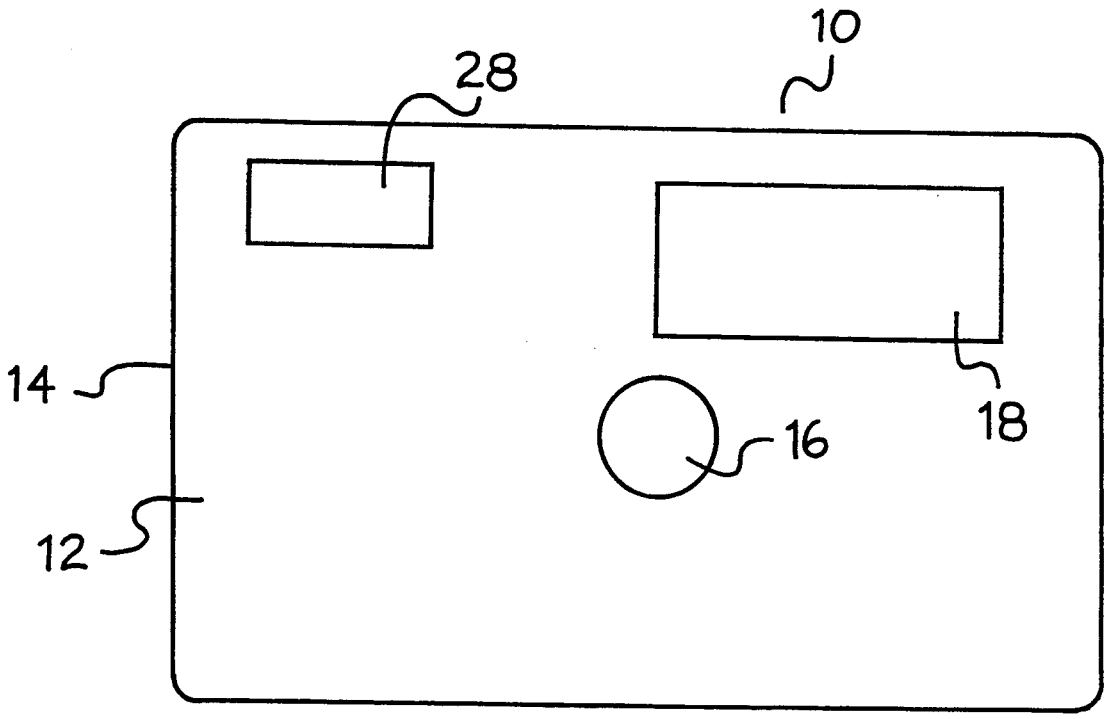
FIG. 8 is a front elevational view of the invention having a flash aperture, lens aperture, and viewfinder aperture.

FIG. 8 shows another aspect of the preferred embodiment in which the object panel 12 has a flash aperture 28 aligned to the flash mechanism of the camera, if it is so equipped as many of the single use cameras are.

Figure 9:
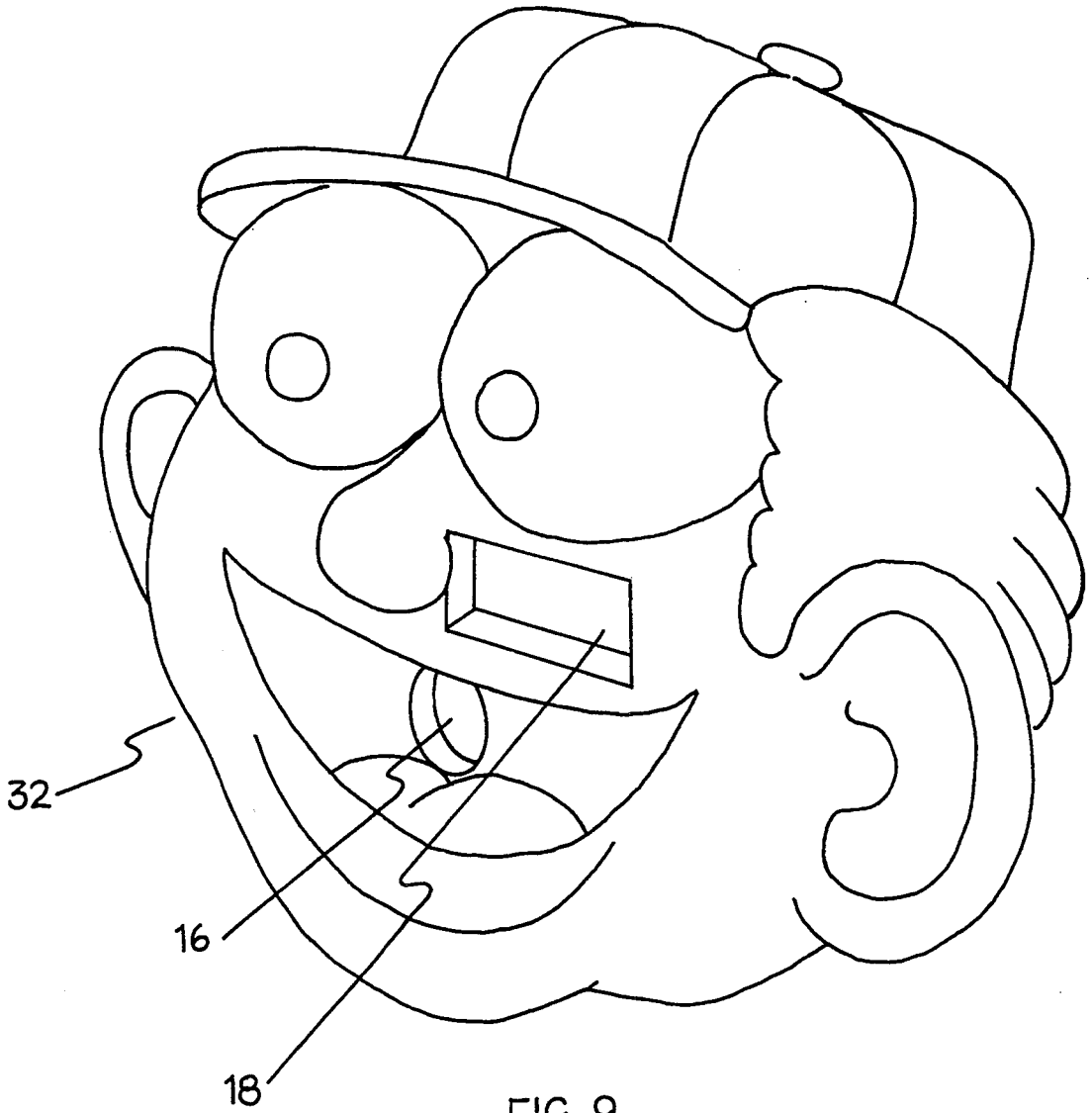
FIG. 9 is a perspective view of an alternative embodiment of the invention comprising three-dimensional decorative, anthropomorphic indicia.

FIG. 9 depicts an alternative embodiment of the invention in which the camera sleeve has an exterior surface 32 comprising decorative, three-dimensional indicia, in addition to a lens aperture 16 and a viewfinder aperture 18. The indicia as shown in FIG. 9 is anthropomorphic in form; however, the indicia can resemble any variety of objects including, for example, a house, a basketball, or an automobile grille. The preferable use of resilient foam as the sleeve material permits the sleeve to be produced by injection molding, thus the contour of the exterior surface 32 of the sleeve will be limited only by the availability of a mold. The decorative sleeve of FIG. 9 has an interior surface similarly contoured like the sleeve described in the preferred embodiment for receiving and securely holding a single use camera.

It will be apparent to a person skilled in the art that changes and modifications to the invention as described are possible without departing from the scope of the invention as is fully set forth in the appended claims.

What is claimed:

1. A removable sleeve for operatively receiving a camera, the camera having an object side and a user side connected by a body wall which defines a periphery of the camera, wherein the object side includes a lens and a viewfinder, the sleeve comprising:

(a) a resilient foam object panel having a lens aperture and a viewfinder aperture; and (b) a resilient foam peripheral wall connected to the object panel and defined by an inner perimeter, wherein the inner perimeter is sized to receive the object side and a portion of the body wall, whereby a frictional force between the peripheral wall and the body wall is sufficient to preclude unintended separation of the camera from the sleeve.

2. The removable sleeve of claim 1, further comprising a carrying strap affixed to the sleeve.

3. The removable sleeve of claim 1, wherein the lens aperture has a sufficient size to permit unobstructed passage of light to the lens upon operable engagement of the sleeve and the camera.

4. The removable sleeve of claim 1, wherein the viewfinder aperture has a sufficient size to permit unobstructed passage of light to the viewfinder upon operable engagement of the sleeve and the camera.

5. The sleeve of claim 1 wherein the object panel includes a flash aperture having a sufficient size for operable passage of light from a flash mechanism of the camera upon operable engagement of the sleeve and the camera.

6. The removable sleeve of claim 1 including three dimensional caricature indicia on an exterior surface of the sleeve.

7. The removable sleeve of claim 6 in which the indicia is anthroponaorphic.

8. A removable sleeve for operatively receiving a camera, the camera having an object side and a user side connected by a body wall which defines a periphery of the camera, wherein the object side includes a lens and a viewfinder, the camera also including a film winder, the sleeve comprising:

(a) a resilient foam object panel having a lens aperture and a viewfinder aperture; and (b) a resilient foam peripheral wall connected to the object panel including an extension projecting along a rear edge of the wall to retain the camera between the extension and the object panel, in which the peripheral wall is defined by an inner perimeter which is sized to receive the object side and the body wall of the camera.

9. The removable sleeve of claim 8 in which the peripheral wall includes a cut-away portion for operation of the film winder.

10. The removable sleeve of claim 8 including three-dimensional indicia projecting from an exterior surface of the sleeve.

11. The removable sleeve of claim 8 further comprising a carrying strap affixed to the sleeve.

12. A resilient foam sleeve for a camera, the camera having a lens, a viewfinder, and a film winder, comprising:

(a) an exterior surface including a rear portion, a side portion and a top portion having a common opening for operably receiving the camera; and (b) a contoured interior surface having a size and shape for frictionally retaining the camera in the sleeve, wherein the sleeve includes at least one clear aperture having a size, shape, and location for operatively aligning with one of the lens, the viewfinder, and the film winder.

13. The removably sleeve of claim 12 further comprising a flash aperture for light emission from a flash mechanism of the camera.

14. The removable sleeve of claim 12 including a carrying strap affixed to the sleeve.

15. The removable sleeve of claim 12 in which the exterior surface comprises decorative three-dimensional indicia.

* * * * *